US011278127B2

(12) United States Patent
Micklos

(10) Patent No.: US 11,278,127 B2
(45) Date of Patent: Mar. 22, 2022

(54) MATTRESS COMPRISING A PLURALITY OF FOAM SPHERES OR HEMISPHERES IN ONE OR MORE SIDE-TO-SIDE CHANNELS

(71) Applicant: Sinomax USA Inc., Houston, TX (US)

(72) Inventor: Josh Micklos, Montgomery, TX (US)

(73) Assignee: SINOMAX USA INC., Houston, TX (US)

( * ) Notice: Subject to any disclaimer, the term of this patent is extended or adjusted under 35 U.S.C. 154(b) by 230 days.

(21) Appl. No.: 16/257,806

(22) Filed: Jan. 25, 2019

(65) Prior Publication Data

US 2020/0237112 A1 Jul. 30, 2020

(51) Int. Cl.

| | |
|---|---|
| ***A47C 27/15*** | (2006.01) |
| ***A47C 27/08*** | (2006.01) |
| ***A47C 27/14*** | (2006.01) |

(52) U.S. Cl.

CPC ..... *A47C 27/15* (2013.01); *A47C 27/088* (2013.01); *A47C 27/144* (2013.01); *A47C 27/148* (2013.01)

(58) Field of Classification Search

CPC ..... A47C 27/15; A47C 27/088; A47C 27/144; A47C 27/148; A47C 27/065; A47C 27/20; A47C 27/062; A47C 27/14; A47C 27/142

See application file for complete search history.

(56) References Cited

U.S. PATENT DOCUMENTS

| | | | | |
|---|---|---|---|---|
| 5,231,717 | A * | 8/1993 | Scott | A47C 27/148 5/400 |
| 6,061,856 | A * | 5/2000 | Hoffmann | A47C 27/148 5/706 |
| 6,704,962 | B2 * | 3/2004 | Choi | A47C 27/15 5/655.9 |
| 8,918,935 | B2 * | 12/2014 | Gladney | A47C 27/148 5/730 |
| 2008/0127424 | A1 * | 6/2008 | Rawls-Meehan | A47C 7/027 5/740 |
| 2014/0251219 | A1 * | 9/2014 | Rawls-Meehan | G06Q 30/016 119/28.5 |
| 2017/0156507 | A1 * | 6/2017 | Rawls-Meehan | A47C 27/15 |

* cited by examiner

*Primary Examiner* — Eric J Kurilla
(74) *Attorney, Agent, or Firm* — Williams Morgan, P.C.

(57) ABSTRACT

A mattress comprising a first layer comprising at least one channel extending laterally from a first side of the layer to an opposite side of the layer, and a plurality of foam spheres or hemispheres disposed in each channel. A mattress assembly comprising the mattress and a mattress foundation.

20 Claims, 5 Drawing Sheets

MATTRESS COMPRISING A PLURALITY OF FOAM SPHERES OR HEMISPHERES IN ONE OR MORE SIDE-TO-SIDE CHANNELS

BACKGROUND OF THE INVENTION

Field of the Invention

Generally, the present disclosure relates to bedding, and, more specifically, to a mattress comprising a plurality of foam spheres or hemispheres in one or more side-to-side channels.

Description of the Related Art

Foam mattresses, such as viscoelastic or so-called "memory foam" mattresses, provide desirably high levels of firmness and support for many users. However, mattresses comprising only viscoelastic foam may lack sufficient support for some users. Also, mattresses comprising only viscoelastic foam may lack desired levels of support for certain regions of a user's body.

The present disclosure may address and/or at least reduce one or more of the problems identified above.

SUMMARY OF THE INVENTION

The following presents a simplified summary of the disclosure in order to provide a basic understanding of some aspects of the disclosure. This summary is not an exhaustive overview of the disclosure. It is not intended to identify key or critical elements of the disclosure, or to delineate the scope of the disclosure. Its sole purpose is to present some concepts in a simplified form as a prelude to the more detailed description that is discussed later.

In one embodiment, the present disclosure is directed to a mattress, comprising a first layer comprising at least one channel extending laterally from a first side of the layer to an opposite side of the layer; and a plurality of foam spheres or hemispheres disposed in each channel.

In one embodiment, the present disclosure is directed to a mattress assembly, comprising a mattress comprising a first layer comprising at least one channel extending laterally from a first side of the layer to an opposite side of the layer, and a plurality of foam spheres or hemispheres disposed in each channel; and a mattress foundation disposed under the mattress.

In one embodiment, the present disclosure is directed to a mattress, comprising a first layer comprising at least one channel extending laterally from a first side of the layer to an opposite side of the layer; a plurality of foam spheres or hemispheres disposed in each channel; and a viscoelastic foam layer disposed directly above the first layer.

The present disclosure may provide for mattresses with improved comfort for users reclining thereon.

BRIEF DESCRIPTION OF THE DRAWINGS

The disclosure may be understood by reference to the following description taken in conjunction with the accompanying drawings, in which like reference numerals identify like elements, and in which.

Figure 1:
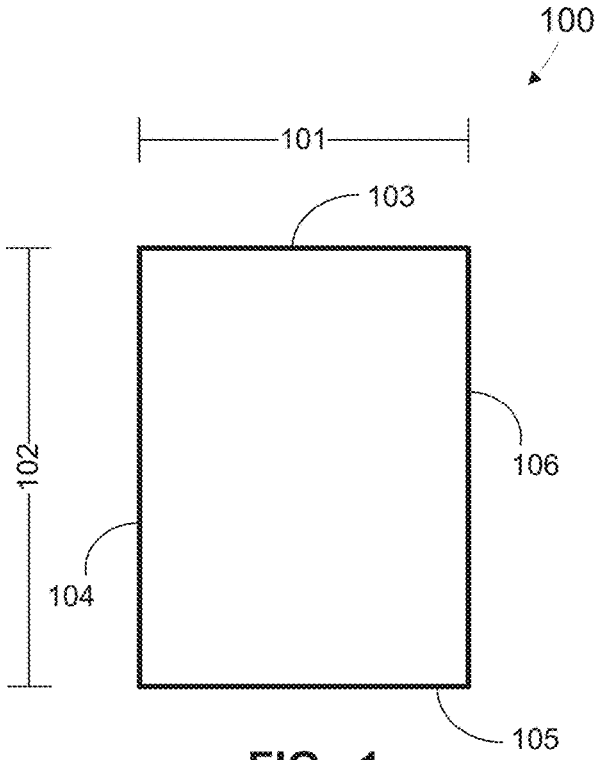
FIG. 1 illustrates a stylized top view of a mattress, in accordance with embodiments herein.

While the subject matter disclosed herein is susceptible to various modifications and alternative forms, specific embodiments thereof have been shown by way of example in the drawings and are herein described in detail. It should be understood; however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

DETAILED DESCRIPTION

Various illustrative embodiments of the disclosure are described below. In the interest of clarity, not all features of an actual implementation are described in this specification. It will, of course, be appreciated that, in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would be a routine undertaking for those of ordinary skill in the art having the benefit of this disclosure.

The present subject matter will now be described with reference to the attached figures. Various structures, systems and devices are schematically depicted in the drawings for purposes of explanation only and to not obscure the present disclosure with details that are well known to those skilled in the art. Nevertheless, the attached drawings are included to describe and explain illustrative examples of the present disclosure. The words and phrases used herein should be understood, and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Embodiments herein are directed to mattresses comprising both comfort and support layers.

Turning to FIG. 1, a stylized top view of a mattress 100, in accordance with embodiments herein, is illustrated. The mattress 100 has a generally rectangular profile in top view, with opposed shorter sides 103, 105 each having a dimension 101, and opposed longer sides 104, 106 each having a dimension 102. Typically, the shorter sides 103, 105 provide the head and foot ends, respectively, of the mattress 100, and the longer sides 104, 106 provide the sides of the mattress 100.

Figure 2:
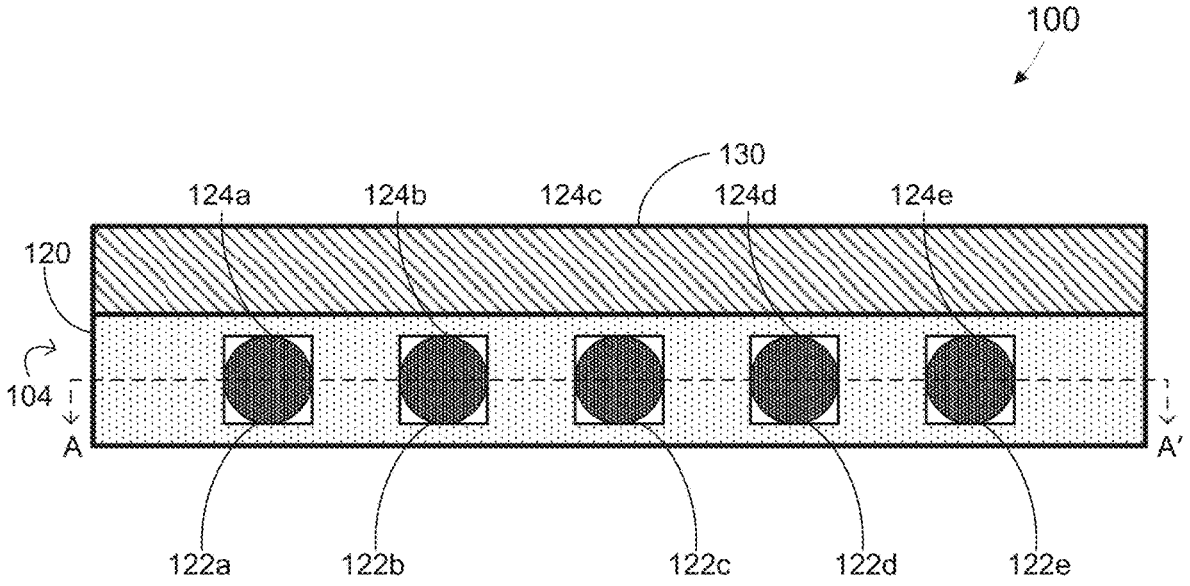
FIG. 2 illustrates a stylized side view of a mattress, in accordance with embodiments herein.

FIG. 2 illustrates a stylized side view of the mattress 100, in accordance with embodiments herein. The side view shows the longer side 104.

The mattress 100 includes a first layer 120. The first layer 120 comprises at least one channel 122, e.g., as shown in FIG. 2, five channels 122*a*, 122*b*, 122*c*, 122*d*, and 122*e*, each extending laterally from a first side 104 to an opposite side 106 of the mattress 100. Disposed in each channel is at least one foam sphere or hemisphere 124, such as foam spheres or hemispheres 124*a*-124*e*. In the side view of FIG. 2, in each channel 122*a*-122*e*, only one foam sphere or hemisphere 124*a*-124*e* is visible. Arrangements of foam spheres or hemispheres 124 in channels 122 will be described in more detail below.

The first layer 120 may comprise a visco-elastic foam, a non-viscoelastic foam, or a polyurethane foam, among other materials. In one embodiment, the first layer 120 comprises a non-viscoelastic foam.

In the depicted embodiment, the mattress 100 may also comprise a comfort layer 130 disposed directly above the first layer 120. The comfort layer 130 may comprise any material and/or assemblage of sublayers suitable for providing comfort to a user reclining on the mattress 100. In one embodiment, the comfort layer 130 comprises a foam. In a particular embodiment, the comfort layer 130 comprises a viscoelastic foam. For example, the viscoelastic foam may have a density from about 25 kg/m$^3$ to about 250 kg/m$^3$, such as from about 50 kg/m$^3$ to about 120 kg/m$^3$. In an even more particular embodiment, the viscoelastic foam may have a density of about 80-85 kg/m$^3$. Alternatively, or in addition, the viscoelastic foam may have a hardness from about 5 N to about 20 N, such as a hardness of about 10 N. Alternatively or in addition, the comfort layer 130 may include a base sublayer and a pillow-top sublayer.

The first layer 120 and the comfort layer 130 may be bonded together by any suitable adhesive. The first layer 120 and the comfort layer 130 (if any) may be assembled using any process and/or equipment known in the art.

For the avoidance of doubt, and in accordance with practice before the United States Patent and Trademark Office, none of the present figures are to scale.

The first layer 120 will now be described in more detail, with reference to FIGS. 2-8.

Foam spheres or hemispheres 124*a*-124*e* generally have a spherical or hemispherical resilient body made of foam. In one embodiment, the foam spheres or hemispheres 124*a*-124*e* comprise polyurethane foam. The foam spheres or hemispheres 124-124*e* may have some compressibility when under load, thereby providing improved comfort to a user of the mattress 100. Alternatively, the foam spheres or hemispheres 124-124*e* may resist compression when under load, thereby relieving pressure points to the user of the mattress 100.

Figure 3:
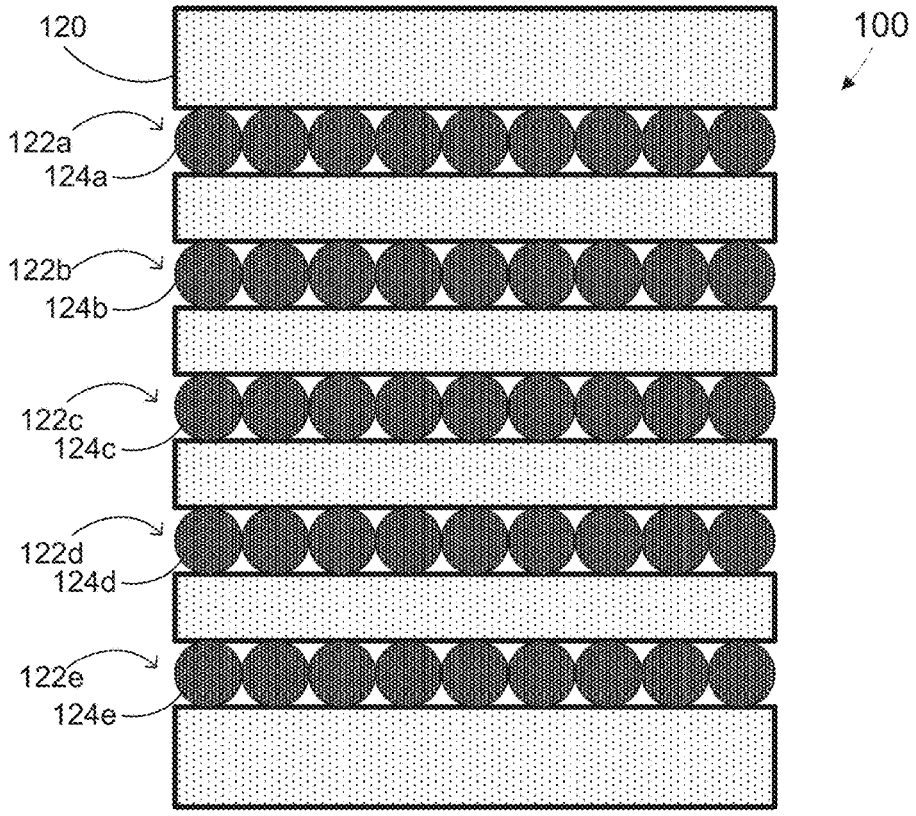
FIG. 3 illustrates a stylized sectional view of the mattress shown in FIG. 2, in accordance with embodiments herein.

Turning to FIG. 3, a sectional view taken along the line A-A' in FIG. 2 is shown. This sectional view looks down across the middle of the first layer 120. As shown, each channel 122*a*-122*e* comprises a plurality of foam spheres or hemispheres. FIG. 3 illustrates sets of foam spheres or hemispheres 124*a*-124*b*, appearing as rounded features, configured within respective channels 122*a*-122*e*. The channels 122*a*-122*e* may be formed from multiple first layer portions.

As shown in FIG. 3, each channel 122*a*-122*e* may comprise the same number of foam spheres or hemispheres 124.

The embodiment shown in FIGS. 2-3 is exemplary in the number of channels 122 and the number of foam spheres or hemispheres 124 in the channels 122. The person of ordinary skill in the art may vary these and other parameters of the mattress 100 as a routine matter.

Figure 4:
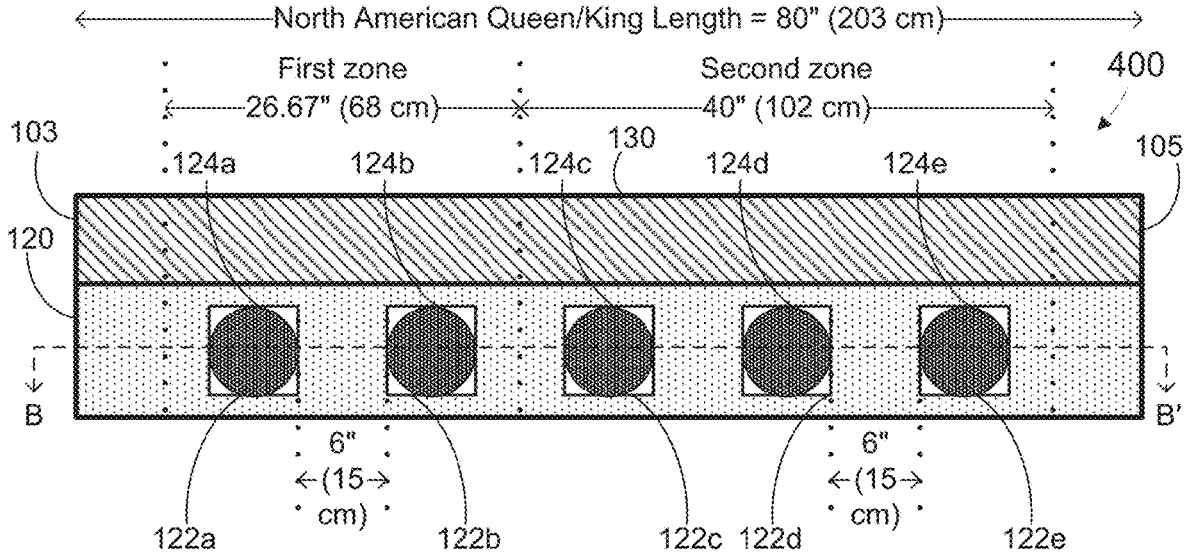
FIG. 4 illustrates a stylized side view of a mattress, in accordance with embodiments herein.
Figure 5:
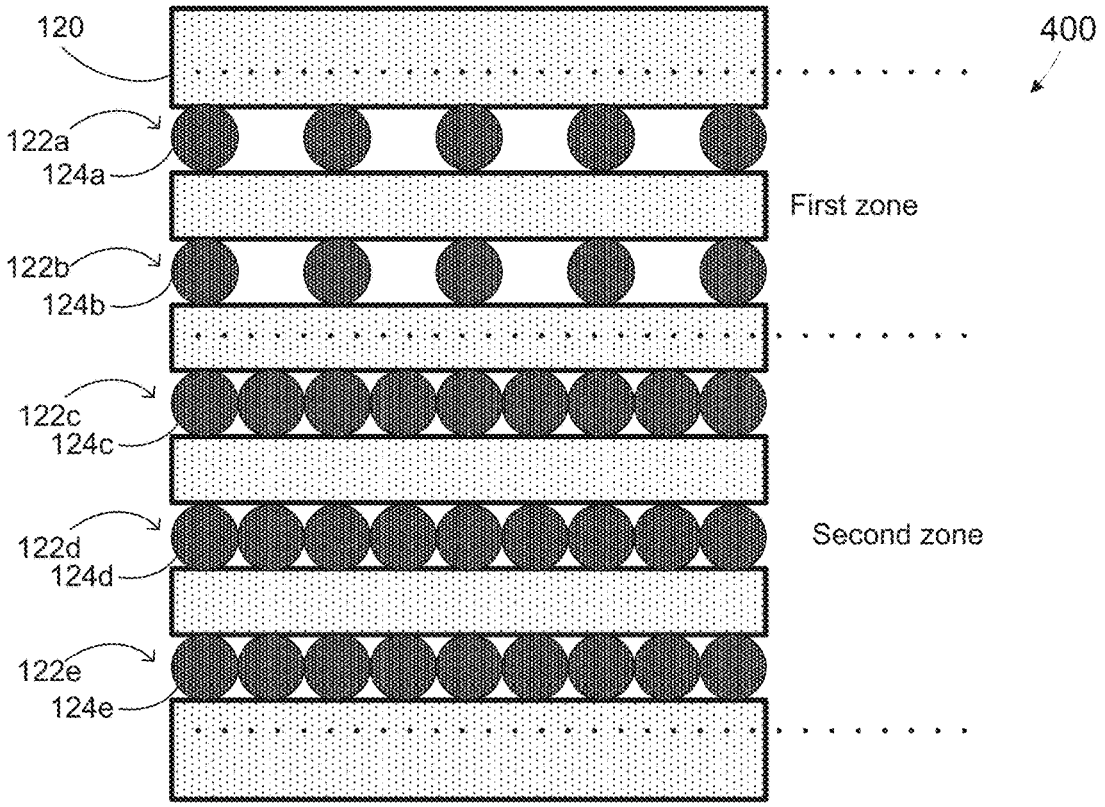
FIG. 5 illustrates a stylized sectional view of the mattress shown in FIG. 4, in accordance with embodiments herein.

Turning now to FIGS. 4-5, another embodiment of a mattress 400 in accordance with embodiments herein is shown. Many of the elements of the mattress 400 are identical to elements of the mattress 100. Such identical elements will be given the same reference numeral and will not be described further.

As shown in FIGS. 4-5, the first layer 120 of the mattress 400 may be considered to comprise at least a first zone and a second zone. The different zones may differ in ways that are differentially impactful on the perceived support of the mattress 400 to a user reclining thereon.

As shown in FIG. 4, each zone has one or more channels 122 disposed laterally therein. Each of the first zone and the second zone have a density of channels, by which is meant one or both of: (a) the length of each zone divided by the number of channels 122 per zone, or (b) a distance between neighboring channels 122 in the zone. In the embodiment depicted in FIG. 4, the mattress 400 is a standard North American queen or king mattress with a length of 80" (203 cm). A first zone (e.g., near the head end 103 of the mattress 400) has a length of 26.67" (68 cm) and a second zone (e.g., near the foot end 105 of the mattress 400) has a length of 40" (102 cm). In the embodiment depicted in FIG. 4, the first zone comprises two channels 122*a* and 122*b*, and the second zone comprises three channels 122*c*, 122*d*, and 122*e*. In both zones, the distance between neighboring channels is 6" (15 cm). In this embodiment, accordingly, the first zone and the second zone have the same density of channels under either definition, (a) about 13.33"/channel or (b) about 6" between neighboring channels.

FIG. 5, a top sectional view of the mattress 400 taken along line B-B' in FIG. 4, shows that the first zone and the second zone may differ in the number of foam spheres or hemispheres 124 per channel 122. The number of foam spheres or hemispheres 124 per channel 122 in each zone may be termed the "density of foam spheres or hemispheres" of the zone. For example, as depicted in FIG. 5, the channels 122*a* and 122*b* of the first zone may each contain five foam spheres or hemispheres 124, whereas the channels 122*c*, 122*d*, and 122*e* of the second zone may each contain nine foam spheres or hemispheres 124, i.e., the second zone has a greater density of foam spheres or hemispheres than the first zone. Consequently, the second zone may be perceived by a user reclining on the mattress 400 as providing greater support than the first zone. If the second zone is located proximal to the foot 105 of the mattress 400, the second zone may hence provide greater support and/or pressure point relief to the legs and/or lower back of the user than the first zone provides to the upper back and head of the user.

The embodiment shown in FIGS. 4-5 is, of course, exemplary in the number of channels 122 in the first layer 120, the number of channels 122 in each zone, the number of zones of the first layer 120, the number of foam spheres or hemispheres 124 in the channels 122 of the first zone, and the number of foam spheres or hemispheres 124 in the channels 122 of the second zone. These figures are also exemplary regarding any dimension of the channels 122 and the foam spheres or hemispheres 124. The person of ordinary skill in the art may vary these and other parameters of the mattress 400 as a routine matter.

Figure 6:
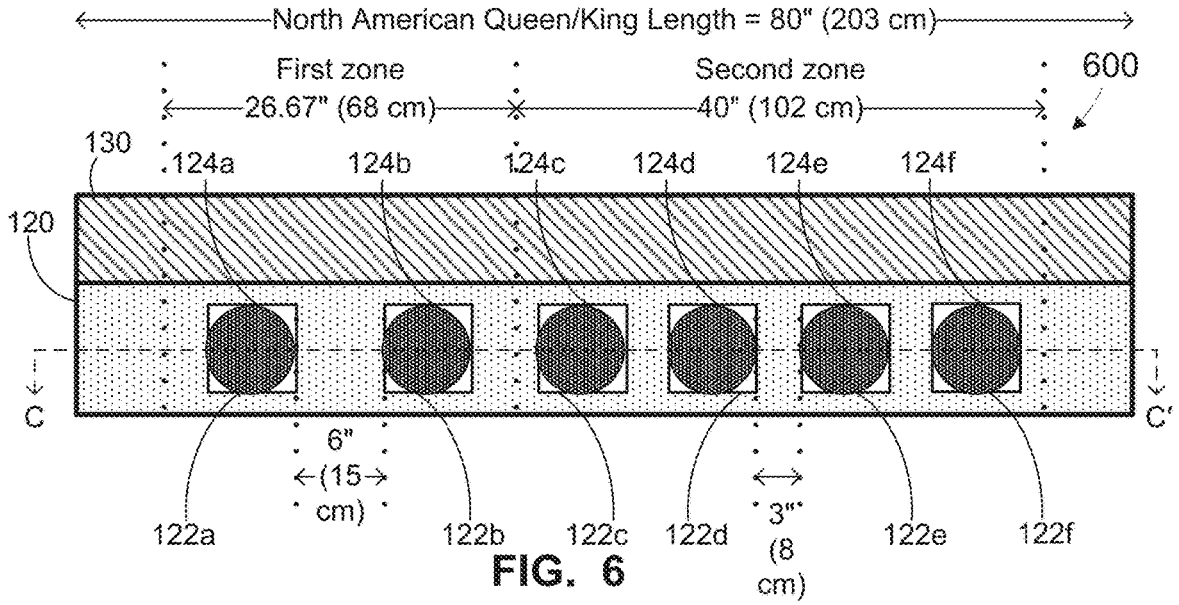
FIG. 6 illustrates a stylized side view of a mattress, in accordance with embodiments herein.
Figure 7:
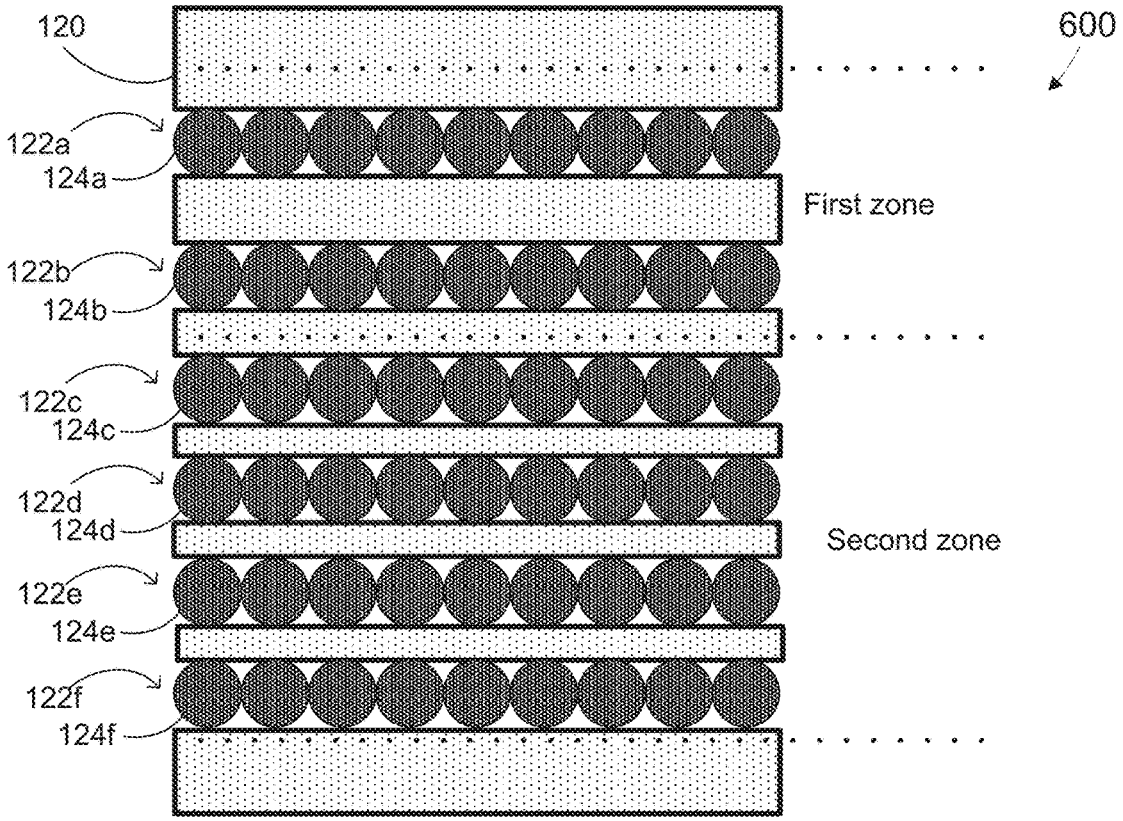
FIG. 7 illustrates a stylized sectional view of the mattress shown in FIG. 6, in accordance with embodiments herein.

Turning now to FIGS. 6-7, an alternative embodiment of a mattress 600 comprising a first zone and a second zone having differential impacts on perceived user support is depicted. The mattress 600 has many elements identical to elements of the mattress 100. Such identical elements will be given the same reference numeral and will not be described further.

As shown in FIG. 6, the first layer 120 of mattress 400 may be considered to comprise at least a first zone and a second zone. The exemplary mattress dimensions are the same as shown in FIG. 4. However, in contrast to the mattress 400 shown in FIG. 4, the first zone of the mattress 600 has a channel density of (a) about 13.33"/channel or (b) about 6" between channels, whereas the second zone of the mattress 600 has a channel density of (a) 40" divided by four channels, or about 10"/channel or (b) about 3" channels. In other words, the mattress 600 of FIG. 6 has a first zone having a first channel density and a second zone having a second channel density, wherein the first channel density differs from the second channel density.

FIG. 7 shows a top sectional view of the mattress 600 taken along line C-C' in FIG. 6. In FIG. 7, the first zone and the second zone have the same number of foam spheres or hemispheres 124 per channel 122.

The embodiment shown in FIGS. 6-7 is, of course, exemplary in the number of channels 122 in the first layer 120, the number of channels 122 in each zone, the number of zones of the first layer 120, the number of foam spheres or hemispheres 124 in the channels 122 of the first zone and the number of foam spheres or hemispheres 124 in the channels 122 of the second zone. These figures are also exemplary regarding any dimension of the channels 122 and the foam spheres or hemispheres 124. The person of ordinary skill in the art may vary these and other parameters of the mattress 600 as a routine matter.

In another embodiment, not shown, a mattress in accordance with embodiments herein may comprise a first layer 120 comprising a first zone and a second zone, wherein the first zone has one or more channels at a first channel density, and a first density of foam spheres or hemispheres in each channel and the second zone has one or more channels at a second channel density, and a second density of foam spheres or hemispheres in each channel; wherein either the first channel density differs from the second channel density; the first density of foam spheres or hemispheres differs from the second density of foam spheres or hemispheres, or both.

Figure 8:
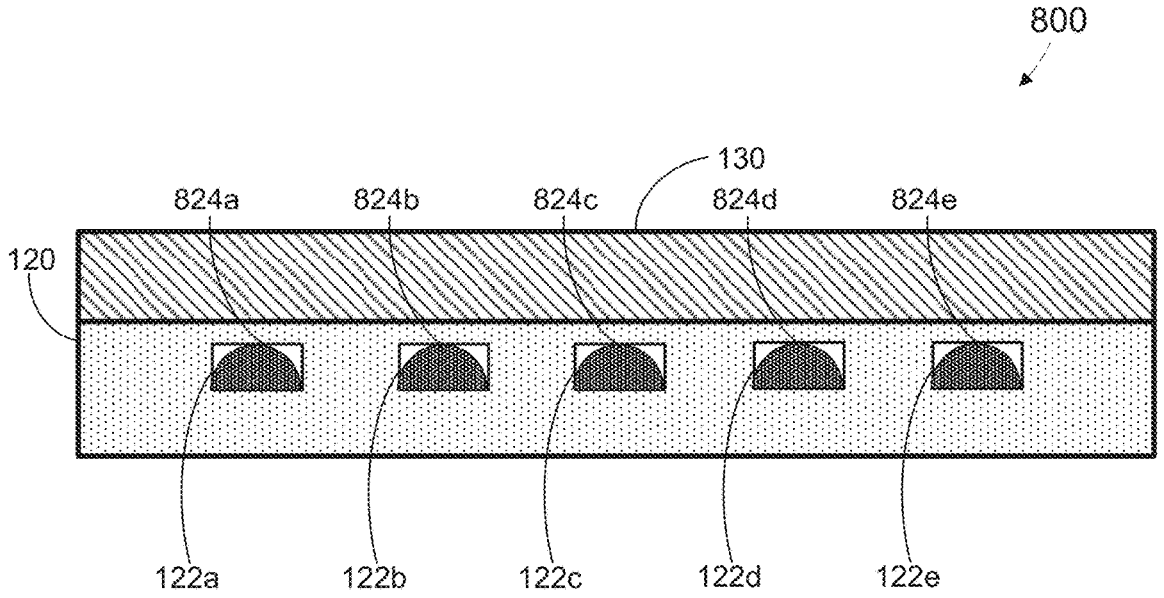
FIG. 8 illustrates a stylized side view of a mattress, in accordance with embodiments herein.

FIG. 8 shows a side view of a mattress 800, which is substantially similar to the mattress 100, except that channels 122*a*-122*e* each contains a plurality of foam hemispheres 824*a*-824*e*. The foam hemispheres 824*a*-824*e* are disposed with the flat face of the hemisphere downward, on the floor of the corresponding channel 122.

Although FIGS. 2-7 show foam spheres 124 and FIG. 8 shows foam hemispheres 824, in any embodiment depicted and described herein, the foam spheres 124 may be substituted with foam hemispheres 824, or vice versa. Further, any embodiment depicted and described herein may involve any combination of foam spheres 124 and foam hemispheres 824.

Figure 9:
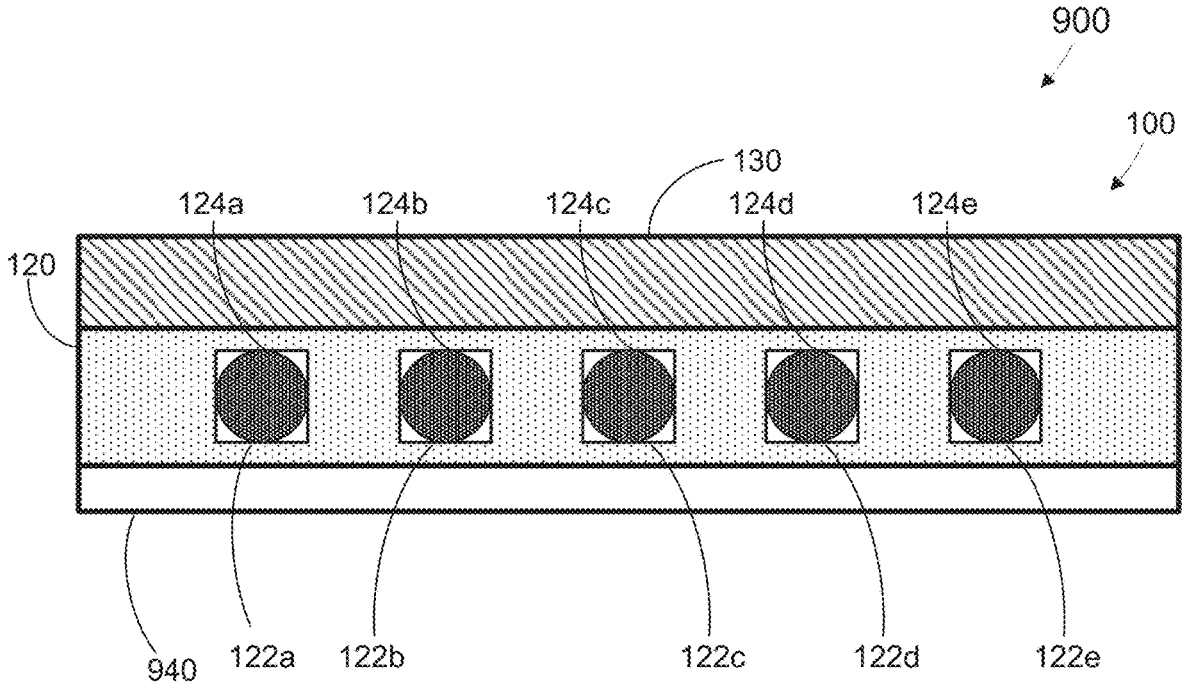
FIG. 9 illustrates a stylized side view of a mattress assembly, in accordance with embodiments herein.

In another embodiment, as depicted in stylized side view in FIG. 9, the present disclosure relates to a mattress assembly 900, in accordance with embodiments herein. The mattress assembly 900 comprises a mattress as described above, such as a mattress 100 comprising a plurality of channels 122*a*-122*e*, each comprising at least one foam sphere or hemisphere 124*a*-124*e*. The mattress assembly may comprise other mattresses described herein, with such other mattresses being substitutable for the mattress 100 in the mattress assembly 900 as a routine matter for the person of ordinary skill in the art.

The mattress assembly 900 also comprises a mattress foundation 940 disposed under the mattress 100. The mattress foundation 940 may comprise any structure known to the person of ordinary skill in the art for the support of mattresses. Exemplary mattress foundations 940 include, but are not limited to, box springs; metal frames; and adjustable supports, including electromechanically adjustable supports; among others.

Figure 10:
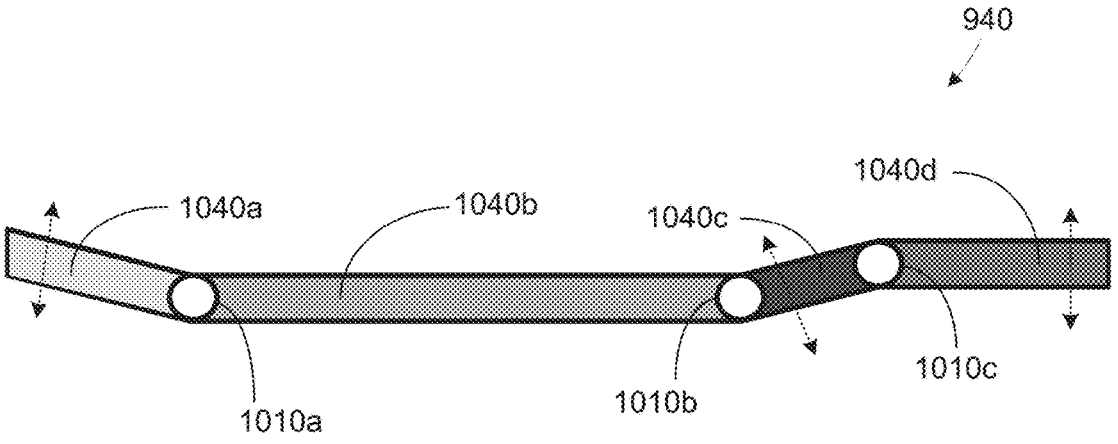
FIG. 10 illustrates a stylized side view depiction of the mattress foundation of FIG. 9, in accordance with embodiments herein.

FIG. 10 illustrates a stylized depiction of the mattress foundation of FIG. 9, in accordance with embodiments herein. In some embodiments, the mattress foundation may be comprised of two or more sections. For example, the mattress foundation 940 may comprise a $1^{st}$ section 1040*a*, a $2^{nd}$ second section 1040*b*, a $3^{rd}$ section 1040*c*, and a $4^{th}$ section 1040*d*. Some or all of the sections 1040*a*-1040*d* may be configured to move independently, as indicated by the dotted lines over the $1^{st}$ section 1040*a*, the $3^{rd}$ section 1040*c*, and the $4^{th}$ section 1040*d*.

Each of the $1^{st}$ through $4^{th}$ section 1040*a*-1040*d* may be connected to pivot points to allow for independent movements. For example, the $1^{st}$ section 1040*a* and the $2^{nd}$ section 1040*b* may be movably coupled to a $1^{st}$ pivot point 1010*a*. In one embodiment, the $1^{st}$ section may move up and down about the $1^{st}$ pivot point 1010*a*. The $1^{st}$ section 1040*a* may be at the head of a bed.

The $2^{nd}$ section 1040*b* and the $3^{rd}$ section may be movably coupled to a $2^{nd}$ pivot point 1010*b*. In one embodiment, the $3^{rd}$ section may move up and down about the $2^{nd}$ pivot point 1010*b*.

The $3^{rd}$ section 1040*c* and the $4^{th}$ section 1040*d* may be movably coupled to a 3rd pivot point 1010*c*. In one embodiment, the $4^{th}$ section may move up and down about the $3^{rd}$ pivot point 1010*c*. In one embodiment, the $4^{th}$ section may be at the foot of a bed. Those skilled in the art would appreciate that additional sections and/or pivot points may be implemented onto the mattress foundation 940 and remain with the spirit and scope of embodiments herein.

The particular embodiments disclosed above are illustrative only, as the disclosure may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is, therefore, evident that the particular embodiments disclosed above may be altered or modified and all such variations are considered within the scope and spirit of the disclosure. Accordingly, the protection sought herein is as set forth in the claims below.

What is claimed is:

1. A mattress, comprising:

a first layer comprising at least one channel extending laterally from a first side of the layer to an opposite side of the layer, wherein a first end of the channel is at least partially exposed on the first side and a second end of the channel is at least partially exposed on the opposite side; and at least one of a plurality of foam spheres, or a plurality of foam hemispheres disposed in each channel.

2. The mattress of claim 1, further comprising:

a comfort layer disposed above the first layer.

3. The mattress of claim 2, wherein the comfort layer comprises a foam.

4. The mattress of claim 3, wherein the foam is a viscoelastic foam.

5. The mattress of claim 1, wherein the first layer comprises a non-viscoelastic foam.

6. The mattress of claim 1, wherein each of the plurality of foam spheres or the plurality of foam hemispheres is a sphere.

7. The mattress of claim 1, wherein the first layer comprises at least a first zone having a first channel density and a second zone having a second channel density, wherein the first channel density differs from the second channel density.

8. The mattress of claim 1, wherein the first layer comprises at least a first zone, having one or more channels and a first density of foam spheres or hemispheres in each channel, and a second zone, having one or more channels and a second density of foam spheres or hemispheres in each channel, wherein the first density of foam spheres or hemispheres differs from the second density of foam spheres or hemispheres.

9. The mattress of claim 1, wherein the first layer comprises at least:

a first zone having one or more channels at a first channel density, and a first density of foam spheres or hemispheres in each channel; and a second zone having one or more channels at a second channel density, and a second density of foam spheres or hemispheres in each channel;

wherein the first channel density differs from the second channel density; and the first density of foam spheres or hemispheres differs from the second density of foam spheres or hemispheres.

10. A mattress assembly, comprising:

a mattress, comprising:

a first layer comprising at least one channel extending laterally from a first side of the layer to an opposite side of the layer, wherein a first end of the channel is at least partially exposed on the first side and a second end of the channel is at least partially exposed on the opposite side; and at least one of a plurality of spheres or a plurality of hemispheres disposed in each channel; and a mattress foundation disposed under the mattress.

11. The mattress assembly of claim 10, wherein the mattress further comprises a comfort layer disposed above the first layer.

12. The mattress assembly of claim 10, wherein the first layer comprises a non-viscoelastic foam.

13. The mattress assembly of claim 10, wherein each of the plurality of spheres or hemispheres is a foam sphere.

14. The mattress assembly of claim 10, wherein the first layer comprises at least a first zone having a first channel density and a second zone having a second channel density, wherein the first channel density differs from the second channel density.

15. The mattress assembly of claim 10, wherein the first layer comprises at least a first zone having one or more channels and a first density of foam spheres or hemispheres in each channel, and a second zone having one or more channels and a second density of foam spheres or hemispheres in each channel, wherein the first density of foam spheres or hemispheres differs from the second density of foam spheres or hemispheres.

16. The mattress assembly of claim 10, wherein the first layer comprises at least:

a first zone having one or more channels at a first channel density, and a first density of foam spheres or hemispheres in each channel; and a second zone having one or more channels at a second channel density, and a second density of foam spheres or hemispheres in each channel;

wherein the first channel density differs from the second channel density; and the first density of foam spheres or hemispheres differs from the second density of foam spheres or hemispheres.

17. A mattress, comprising:

a first layer comprising at least one channel extending laterally from a first side of the layer to an opposite side of the layer, wherein a first end of the channel is at least partially exposed on the first side and a second end of the channel is at least partially exposed on the opposite side;

at least one of a plurality of foam spheres or a plurality of foam hemispheres disposed in a single row in each channel; and a viscoelastic foam layer disposed directly above the first layer.

18. The mattress of claim 17, wherein the first layer comprises a non-viscoelastic foam.

19. The mattress of claim 17, wherein each of the plurality of foam spheres or hemispheres is a sphere.

20. The mattress of claim 17, wherein the first layer comprises at least:

a first zone having one or more channels at a first channel density, and a first density of foam spheres or hemispheres in each channel; and a second zone having one or more channels at a second channel density, and a second density of foam spheres or hemispheres in each channel;

wherein either the first channel density differs from the second channel density, the first density of foam spheres or hemispheres differs from the second density of foam spheres or hemispheres, or both.

* * * * *